United States Patent [19]

Matsumoto et al.

[11] Patent Number: 5,011,083

[45] Date of Patent: Apr. 30, 1991

[54] LIQUID-SPRAYING NOZZLE

[75] Inventors: Kozo Matsumoto; Hiroyoshi Asakawa, both of Nishinomiya, Japan

[73] Assignee: Kyoritsu Gokin Mfg. Co., Ltd., Japan

[21] Appl. No.: 347,074

[22] Filed: May 3, 1989

[51] Int. Cl.[5] ..... B05B 1/02

[52] U.S. Cl. ..... 239/590.5; 239/597

[58] Field of Search ..... 239/589, 590, 590.5, 239/592, 597, 553, 553.5

[56] References Cited

U.S. PATENT DOCUMENTS

| | | | |
|---|---|---|---|
| 1,490,683 | 4/1924 | Straitz | 239/592 |
| 2,985,386 | 5/1961 | Steinen | 239/597 |
| 3,358,783 | 12/1967 | Raynal et al. | 239/592 |
| 3,416,736 | 12/1968 | Marik | 239/597 |
| 3,754,710 | 8/1973 | Chimura | 239/597 |
| 4,618,101 | 10/1986 | Piggott | 239/289 |
| 4,646,977 | 3/1987 | Iwamura et al. | 239/590.5 |
| 4,718,607 | 1/1988 | Levine | 239/597 |

FOREIGN PATENT DOCUMENTS

| | | | |
|---|---|---|---|
| 2927737 | 1/1981 | Fed. Rep. of Germany | 239/590 |
| 3419423 | 11/1984 | Fed. Rep. of Germany | 239/590.5 |

*Primary Examiner*—Andres Kashnikow
*Assistant Examiner*—Christopher G. Trainor
*Attorney, Agent, or Firm*—Gifford, Groh, Sprinkle, Patmore and Anderson

[57] ABSTRACT

A liquid-spraying nozzle has a bottom-equipped nozzle body which includes an inner peripheral face formed at an inner bottom portion of the body and coaxial or substantially coaxial with a nozzle axis and a laterally-elongated orifice defined normal or substantially normal to the nozzle axis when viewed from the direction of the nozzle axis. The invention is characterized by a large-diameter peripheral face formed upstream of the inner peripheral face and having a larger inner diameter than the inner peripheral face, a stepped portion formed between the inner peripheral face and the large-diameter peripheral face, and a pair of elongated grooves disposed along the nozzle axis and at positions opposing to each other across a longitudinal center of the orifice of the inner peripheral face. Each elongated groove has a downstream end relative to the spraying direction with an arcuate cross section extending to the vicinity of the orifice and an upstream end opened at the stepped portion.

4 Claims, 3 Drawing Sheets

FIG. 5
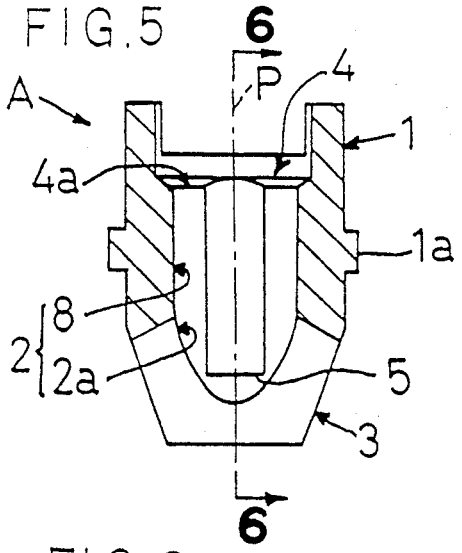
FIG. 6
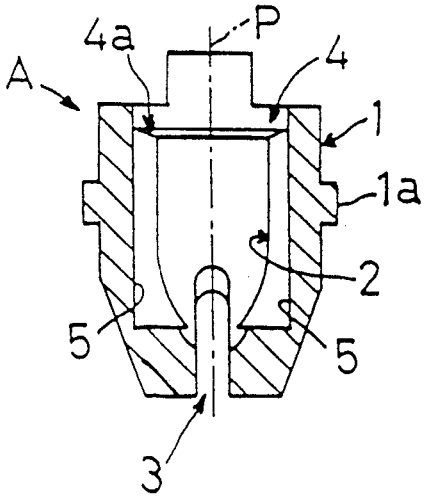
FIG. 8
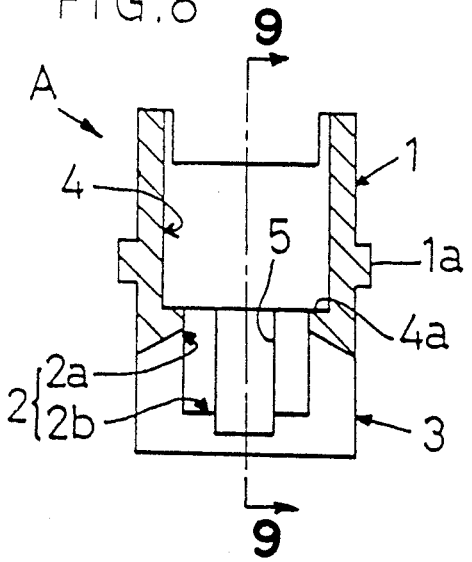
FIG. 9
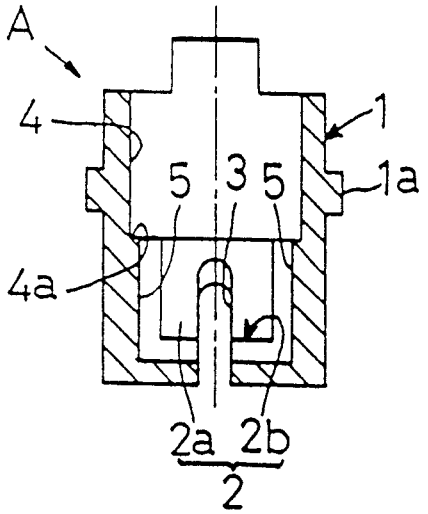
FIG. 10A
PRIOR ART
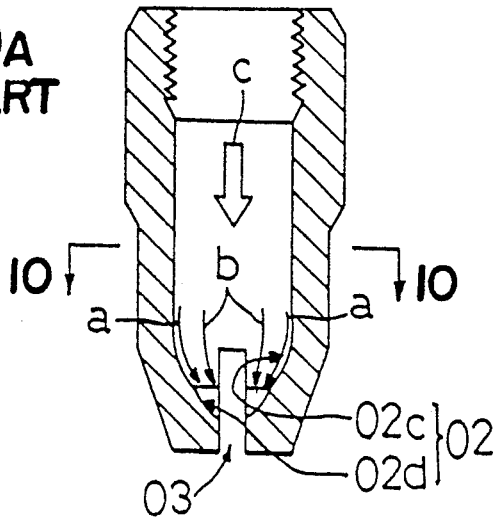
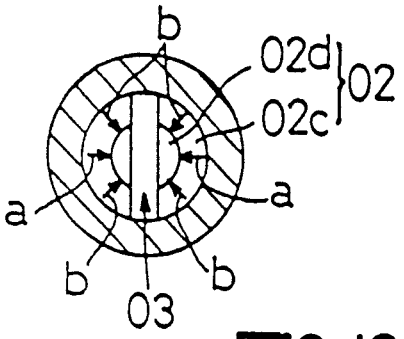
FIG. 10B
PRIOR ART

LIQUID-SPRAYING NOZZLE

BACKGROUND OF THE INVENTION

1. Field of the Invention

The present invention relates to a flat spraying type liquid-spraying nozzle widely used for spray-cooling a red heated steel or a roller conveyor transporting the same or for spraying chemicals onto crops or plants in a vegetable-growing field, an orchard and so on, and more particularly to a liquid-spraying nozzle of the above-noted type including a bottom-equipped cylindrical nozzle body having an inner bottom portion defining an inner peripheral face formed coaxial or substantially coaxial relative to a nozzle axis, at least a bottom portion of the nozzle body having a laterally-elongated orifice defined normal or substantially normal to the nozzle axis when viewed from the direction of the nozzle axis.

2. Description of the Prior Art

With a conventional liquid-spraying nozzle of the above-noted type, since its spraying amount tends to be largest at the longitudinal center of the orifice, it has been necessary to render the spraying amount uniform with respect to the longitudinal direction of the orifice. Thus, according to the prior art, as shown in FIGS. 10(*a*) and 10(*b*), the inner peripheral face 02 is formed of a plurality of steps of curved inner peripheral face portions 02*c* and 02*d* which diameters are gradually reduced towards the downstream in the liquid-spraying direction. In operation, of these curved inner peripheral face portions 02*c* and 02*d*, the liquid portion guided in the directions a and b along the outermost portion 02*c* is caused to collide with liquid portion guided in the direction c towards the second outermost curved inner peripheral portion 02*d*, whereby the liquid as passing through the nozzle is provided with a diffusing-distributing force towards the outer diameter direction away from the nozzle axis. In this way, the prior art has attempted to achieve uniform distribution of the spraying amount (e.g. Japanese patent laid open under Showa 61-161162).

With the above-described construction; however, at the outermost curved inner peripheral portion 02*c*, the liquid portion is guided in the direction b adjacently along the longitudinal direction of the orifice 03 has a significant force towards the longitudinal center of the orifice 03. Hence, this liquid portion may disadvantageously offset or weaken the diffusing-distributing force of the liquid towards the outer diameter direction. Accordingly, this prior construction has often failed to achieve the intended uniform distribution of the spraying amount.

In view of the above-described state of the art, the primary object of the present invention is to provide an improved liquid-spraying nozzle capable of achieving efficient and uniform distribution of its spraying amount through an improvement of the inner peripheral face configuration of the nozzle.

SUMMARY OF THE INVENTION

In order to achieve the above-noted object, a liquid-spraying nozzle related to the present invention comprises: a bottom-equipped nozzle body including an inner peripheral face formed at an inner bottom portion of the body and coaxial or substantially coaxial with a nozzle axis and a laterally-elongated orifice defined normal or substantially normal to the nozzle axis when viewed from the direction of the nozzle axis; a large-diameter peripheral face formed upstream of the inner peripheral face and having a larger inner diameter than the inner peripheral face; a stepped portion formed between the inner peripheral face and the large-diameter peripheral face; and a pair of elongated grooves disposed along the nozzle axis and at positions opposing to each other across a longitudinal center of the orifice of the inner peripheral face, each elongated groove having a downstream end relative to the spraying direction with an arcuate cross section extending to the vicinity of the orifice and an upstream end opened at the stepped portion.

The spraying-liquid nozzle• having the above-described features of the invention has functions and effects to be described next with reference to FIGS. 1 through 3.

As shown, the inner peripheral face 2 is divided into two face portions across the laterally-elongated orifice when viewed in the direction of nozzle axis P. Then, a liquid portion flowing in a direction d along one side portion of the face 2 and another liquid portion flowing in the direction d along the other side portion of the face 2 are are caused to collide with each other when the both liquid portions enter the orifice 3, through which collision the combined liquid acquires a diffusing-distributing force along the longitudinal direction of the orifice 3 to be sprayed flatly through the orifice 3. Further, at positions opposing to each other across a longitudinal center of the orifice 3 of the inner peripheral face 2, there are provided the pair of elongated grooves 5 each having a downstream end thereof adjacent the orifice 3. Accordingly, a further liquid portion guided in a direction e along these elongated grooves 5 is also caused to collide in the vicinity of the orifice 3 with the combined liquid portions guided in the direction d along the inner peripheral face portions. Consequently, compared with the conventional arrangement where the liquid portions guided in the direction d along the inner peripheral face portions alone are caused to collide with each other, the second-mentioned collision may advantageouly add to the diffusing-distributing force provided to the sprayed liquid.

Moreover, since the elongated grooves 5 are formed at a middle position longitudinally of the orifice 3, the liquid portions guided in the direction e along the respective elongated grooves 5 collide with each other at a position substantially on the nozzle axis P to be diffused therefrom to the right and left, i.e. in the direction normal to the longitudinal direction of the orifice 3, thereby effectively increasing the diffusing-distributing force of the liquid.

In addition, since each elongated groove 5 is formed along the nozzle axis P and having its upstream end opened at the stepped portion, the liquid portion passing the vicinity of the large-diameter peripheral face 4 may flow smoothly into the grooves 5 without much energy loss. Also, the manufacturing of the elongated grooves 5 is facilitated when compared e.g. with a case where the elongated grooves alone are to be formed concave.

In summary, the present invention has provided a liquid-spraying nozzle which may flatly spray liquid in a very efficient and uniform manner because of the enhanced diffusing-distributing force provided to the liquid and yet which may be manufactured very easily.

Furthermore, according to one preferred embodiment of the present invention, the inner peripheral face is formed as a tapered curved inner peripheral face. This arrangement has the advantages that the liquid may flow more smoothly along the peripheral face whereby the energy loss may be further reduced.

BRIEF DESCRIPTION OF THE DRAWINGS

Accompanying drawings FIGS. 1 through 9 show preferred embodiments of the present invention; in which, FIG. 1 is a side view in section of a major portion, FIG. 2 is a side view in section taken along a line 2—2 of FIG. 1, FIG. 3 is a section view taken along a line 3—3 of FIG. 1, FIG. 4 is a graph showing spraying characteristics, FIGS. 5 through 9 show an alternate embodiment of the invention, with FIG. 5 being a side view in section of a major portion, FIG. 6 being a side view in section taken along a line 4—4 of FIG. 5, FIG. 7 being a graph showing spraying characteristics, FIG. 8 being a side view in section of a major portion, and with FIG. 9 being a side view in section of the major portion taken along a line 9—9 of FIG. 8, respectively, and FIGS. 10(*a*) and 10(*b*) show a conventional liquid-spraying nozzle, with FIG. 10(*a*) being a side view in section of a major portion and FIG. 10(*b*) being a perspective view taken along a line 10—10 of FIG. 10(*a*).

DESCRIPTION OF THE PREFERRED EMBODIMENTS

Preferred embodiments of the invention will be particularly described hereinafter with reference to the accompanying drawings.

Figure 1:
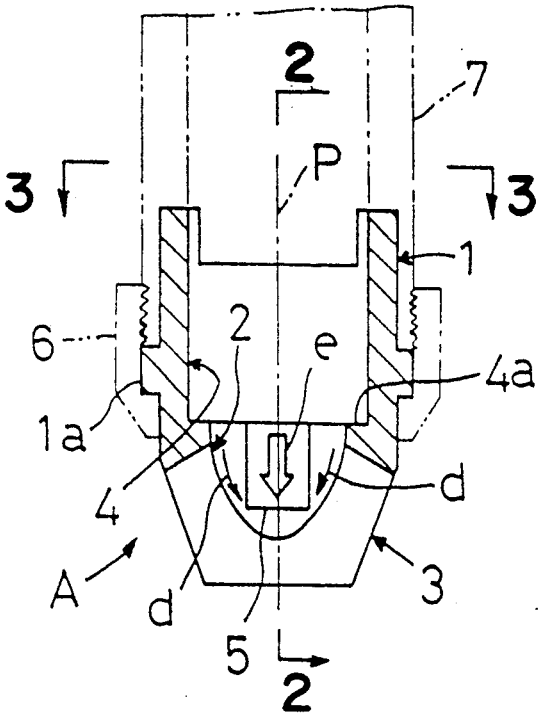
Figure 2:
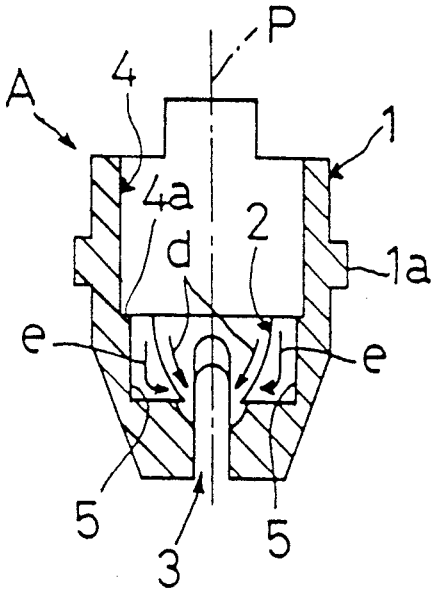
Figure 3:
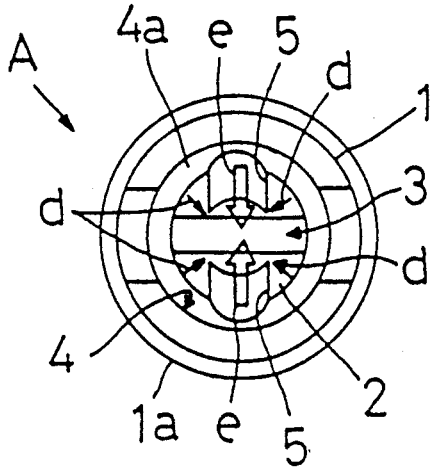

FIGS. 1 through 3 show a liquid-spraying nozzle A for use in e.g. spraying cooling water onto a continuously casted steel. As shown, this nozzle A includes a bottom-equipped nozzle body 1, a tapered curved inner peripheral face 2 defined at an inner bottom portion of the body 1 and coaxially or substantially coaxially with a nozzle axis P, a laterally-elongated orifice 3 defined at a bottom portion of the nozzle body 1 and normal or substantially normal to the nozzle axis P, a large-diameter peripheral face 4 formed upstream of the inner peripheral face 2 and having a larger inner diameter than the face 2, and a stepped portion 4*a* formed between the inner peripheral face 2 and the large-diameter peripheral face 4.

Further, at positions opposing to each other across a longitudinal center of the orifice 3 of the inner peripheral face 2, there are formed by cutting a pair of elongated grooves 5 disposed along the nozzle axis P. Each elongated groove 5 has a downstream end (relative to the liquid-spraying direction) with an arcuate cross section extending to the vicinity of the orifice 3 and an upstream end opened at the stepped portion 4*a*.

The nozzle body 1 includes at an outer periphery thereof a flange 1*a* to be fixedly engaged into a screw type pipe coupler 6 which is attached into a discharge pipe 7 of an unillustrated gas-liquid mixer.

With the above-described construction, a liquid portion passing the large-diamter peripheral face 4 flows in the direction of the axis P and reaches the stepped portion 4*a*, the liquid portion is caused to collide with a further liquid portion flowing closely along the nozzle axis P, through which collision the liquid portion is provided with a diffusing-distributing force. Then, a portion of the converged liquid flows along the curved inner peripheral face 2 thereby acquiring an acceleration while another portion of the liquid smoothly flows as being guided by the elongated grooves 5.

Thereafter, the liquid portions opposing to each other and smoothly and constrictedly guided along the curved inner peripheral face 2 collide with each other when running into the orifice 3 thereby acquiring a diffusing-distributing force along the longitudinal direction of the orifce.

Further at the longitudinal center of the orifice 3, the liquid portions guided along the pair of elongated grooves 5 also collide with each other across the orifice 3. Then, the above-mentioned diffusing-distributing force provided by the collision between the liquid portions guided along the face 2 is further increased by the collision between the liquid portions guided along the grooves 5. Consequently, the nozzle may spray the liquid very efficiently and uniformly.

Figure 4:
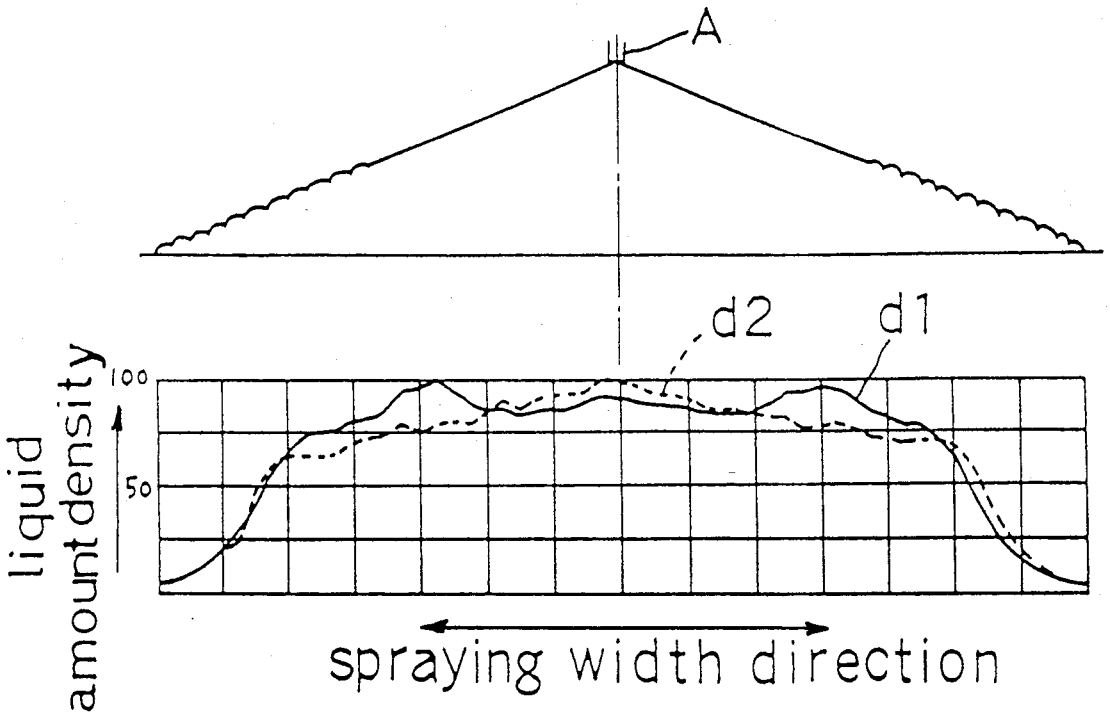

In FIG. 4, a line d1 shows measurement results of sprayed liquid distribution in the width direction of the spraying achieved by the the liquid-spraying nozzle of this embodiment used in combination with a conventional gas-liquid mixer disclosed e.g. in a Japanese laid-open patent No. 61-161162.

The vertical axis of the graph represents the liquid amount density with its maximum value 100 whereas the horizontal axis represents the position in the width direction of the spraying. The measurements were conducted under the conditions specified as follows:

| | |
|---|---|
| air pressure (PA) | 3.00 K f/cm$^2$ G |
| water pressure (PW) | 3.00 Kg f/cm$^2$ |
| air pressure (QA) | 58.8 Nm$^2$/h |
| water amount (QW) | 17.5 l/min |
| air/water volume ratio (QA/QW) | 56.00 |

In FIG. 4, a line d2 shows measurement results of sprayed liquid distribution in the width direction of the spraying achieved by a liquid-spraying nozzle which construction is the same as the above nozzle A of this embodiment except that the former does not have the elongated grooves 5. As these spraying amount distribution performances are compared, it may be readily seen that the elongated grooves 5 contribute significantly to the uniformity and efficiency of the spraying amount distribution.

FIGS. 5 and 6 show a liquid-spraying nozzle according to a further embodiment of the present invention. In the spraying nozzle of this embodiment, the inner peripheral face 2 is formed by continuation of a peripheral face 8 having a constant diameter along the nozzle axis P and a tapered curved peripheral face 2*a*. The upstream end of the face 2, i.e. of the face 8 is formed continuous with the large-diameter portion 4 via the stepped portion 4*a*. Further, the elongated grooves 5 have their upstream ends opened at the stepped portion 4*a* such that the grooves 5 are formed continuous with the large-diameter portion 4.

The rest of the construction are the same as those of the previous embodiment.

Figure 7:
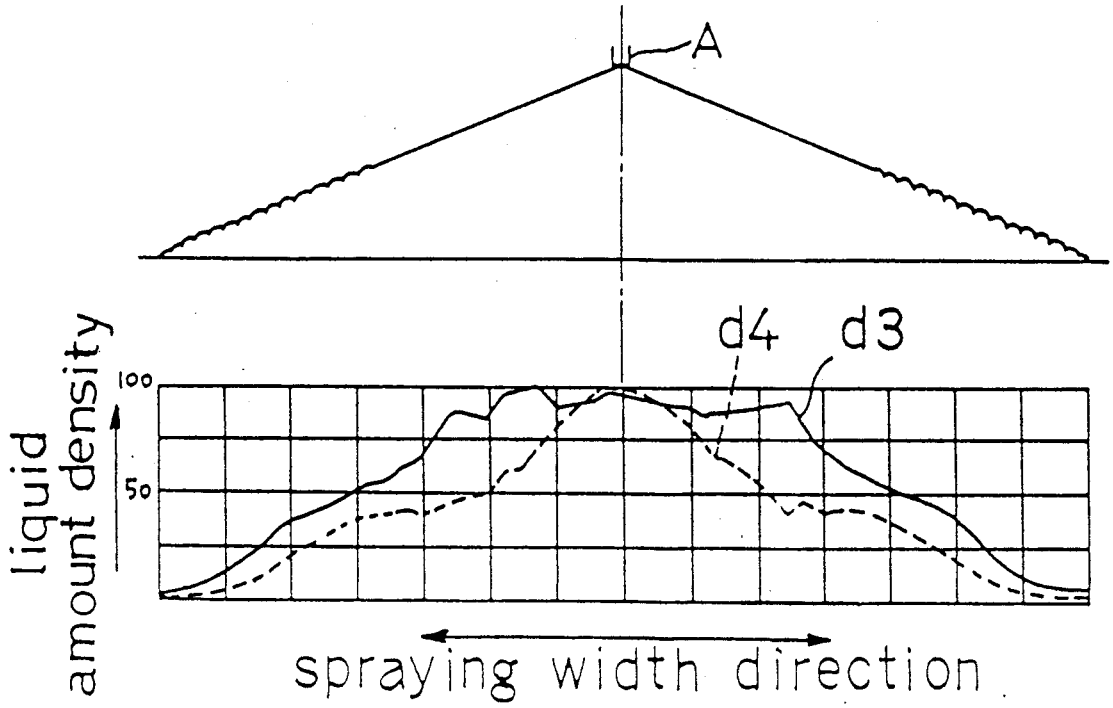

In FIG. 7, a line d3 shows measurement results of sprayed liquid distribution in the width direction of the spraying achieved by the the liquid-spraying nozzle A of this embodiment. Whereas, a line d4 in the same drawing shows the results of a nozzle having the same construction as that of this embodiment except that the former does not have the elongated grooves 5.

The measurements were conducted under the conditions specified as follows:

| | |
|---|---|
| air pressure (PA) | 3.00 Kg f/cm$^2$ G |
| water pressure (PW) | 3.00 Kg f/cm$^2$ |
| air pressure (QA) | 58.0 Nm$^2$/h |
| water amount (QW) | 17.5 l/min |
| air/water volume ratio (QA/QW) | 56.00 |

As these spraying amount distribution performances are compared, it may be readily seen again that the elongated grooves 5 contribute significantly to the uniformity and efficiency of the spraying amount distribution.

FIGS. 8 and 9 show a liquid-spraying nozzle according a still further embodiment of the present invention. The spraying nozzle of this embodiment includes at an inner bottom portion thereof the inner peripheral face 2 formed by a peripheral face 2*a* having a constant diameter along the nozzle axis P and a flat bottom face 2*b*. The upstream end of the face 2, i.e. of the face 2*a* is formed continuous with the large-diameter portion 4 via the stepped portion 4*a*. Further, the pair of elongated grooves 5 are formed across the peripheral face 2*a* and the bottom face 2*b* and opposed at the downstream ends thereof to each other across the orifice 3.

The elongate groove may have an angular cross section.

The downstream end of the elongated groove may be formed as a tapered face inclined relative to the nozzle axis.

What is claimed is:

1. A liquid-spraying nozzle comprising:

a bottom-equipped tubular nozzle body 1, including;

an inner peripheral face 2 formed at an inner bottom portion of the body 1 and coaxial or substantially coaxial with a nozzle axis P, a laterally-elongated orifice 3 defined at least in a part of the bottom portion of said nozzle body normal or substantially normal to the nozzle axis P when viewed from the direction of the nozzle axis, said orifice substantially crossing the nozzle body 1 and having a uniform width over its entire lateral extent;

a large-diameter peripheral face 4 formed upstream of said inner peripheral face 2 and having a larger inner diameter than said inner peripheral face 2;

a stepped portion 4*a* formed and connecting between said inner peripheral face 2 and said large-diameter peripheral face 4, and a pair of elongated grooves 5 disposed along the inner peripheral face extending in the direction of the nozzle axis P and having substantially parallel opposing faces facing each other, each said elongated groove 5 having an arcuate cross section, a downstream end in the vicinity of said orifice 3 and an upstream end opened at said stepped portion 4*a;* whereby liquid flowing from said large-diameter peripheral face 4 and liquid flowing from said pair of elongated grooves flows in a continuous downstream direction into said orifice 3.

2. A liquid-spraying nozzle as defined in claim 1, wherein said inner peripheral face 2 includes a tapered inner peripheral face 2*a*.

3. A liquid-spraying nozzle as defined in claim 1, wherein said inner peripheral face 2 is formed by a peripheral face 8 having a constant diameter along the nozzle axis P and a tapered curved peripheral face 2*a*.

4. A liquid-spraying nozzle as defined in claim 1, wherein said inner peripheral face 2 is formed by a peripheral face 2*a* having a constant diameter along the nozzle axis P and a flat bottom face 2*b*.

* * * * *